US006447368B1

(12) United States Patent
Fruitman et al.

(10) Patent No.: US 6,447,368 B1
(45) Date of Patent: Sep. 10, 2002

(54) CARRIERS WITH CONCENTRIC BALLOONS SUPPORTING A DIAPHRAGM

(75) Inventors: Clinton O. Fruitman, Chandler; Timothy S. Dyer, Tempe, both of AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 141 days.

(21) Appl. No.: 09/716,873

(22) Filed: Nov. 20, 2000

(51) Int. Cl.[7] ..... B24B 49/03

(52) U.S. Cl. ..... 451/5; 451/287; 451/398; 451/41

(58) Field of Search ..... 451/5, 41, 286, 451/287, 288, 289, 397, 398

(56) References Cited

U.S. PATENT DOCUMENTS

| | | | | |
|---|---|---|---|---|
| 5,205,082 A | | 4/1993 | Shendon et al. | |
| 5,230,184 A | | 7/1993 | Bukhman | |
| 5,584,746 A | | 12/1996 | Tanaka et al. | |
| 5,584,751 A | | 12/1996 | Kobayashi et al. | |
| 5,605,488 A | | 2/1997 | Ohashi et al. | |
| 5,624,299 A | | 4/1997 | Shendon | |
| 5,660,517 A | | 8/1997 | Thompson et al. | |
| 5,681,215 A | | 10/1997 | Sherwood et al. | |
| 5,738,574 A | | 4/1998 | Tolles et al. | |
| 5,762,539 A | | 6/1998 | Nakashiba et al. | |
| 5,762,544 A | | 6/1998 | Zuniga et al. | |
| 5,762,546 A | | 6/1998 | James et al. | |
| 5,795,215 A | | 8/1998 | Guthrie et al. | |
| 5,820,448 A | | 10/1998 | Shamouilian et al. | |
| 5,964,653 A | | 10/1999 | Perlov et al. | |
| 6,080,050 A | * | 6/2000 | Chen et al. | 451/288 |
| 6,093,089 A | | 7/2000 | Chen et al. | 451/288 |
| 6,277,009 B1 | * | 8/2001 | Chen et al. | 451/288 |
| 6,336,853 B1 | * | 1/2002 | Schultz et al. | 451/287 |
| 6,375,550 B1 | * | 4/2002 | Berman | 451/288 |
| 6,390,905 B1 | * | 5/2002 | Korovin et al. | 451/286 |

FOREIGN PATENT DOCUMENTS

| | | |
|---|---|---|
| EP | 0 786 310 A1 | 7/1997 |
| EP | 0 790 100 A1 | 8/1997 |
| EP | 0 791 431 A1 | 8/1997 |
| EP | 0 841 123 A1 | 5/1998 |

* cited by examiner

*Primary Examiner*—Timothy V. Eley
*Assistant Examiner*—David B. Thomas
(74) *Attorney, Agent, or Firm*—James L. Farmer

(57) ABSTRACT

The invention is a chemical-mechanical polishing wafer carrier that is able to apply a plurality of different pressures, with minimal discontinuities at the interfaces between different pressures, through a diaphragm to a back surface of a wafer. A plurality of concentric balloons, that may be individually pressurized, is used to support and press on the back surface of the diaphragm. The walls of the balloons are preferably thin and elastic and preferably do not attach to the diaphragm. This helps to minimize any pressure discontinuities on the diaphragm along the interfaces between the balloons. A wafer may be placed against the front surface of the diaphragm allowing the front surface of the diaphragm to retain and press against the back surface of the wafer during a planarization process.

13 Claims, 3 Drawing Sheets

CARRIERS WITH CONCENTRIC BALLOONS SUPPORTING A DIAPHRAGM

TECHNICAL FIELD

The present invention relates generally to semiconductor manufacturing, and more specifically to a carrier for retaining and pressing a semiconductor wafer against a polishing pad in a chemical-mechanical polishing tool to remove material and planarize the front surface of the wafer.

BACKGROUND OF THE INVENTION

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. The front face of the wafer on which integrated circuitry is to be constructed must be extremely flat in order to facilitate reliable semiconductor junctions with subsequent layers of material applied to the wafer. Also, the material layers (deposited thin film layers usually made of metals for conductors or oxides for insulators) applied to the wafer while building interconnects for the integrated circuitry must also be made a uniform thickness.

Planarization is the process of removing projections and other imperfections to create a flat planar surface, both locally and globally, and/or the removal of material to create a uniform thickness for a deposited thin film layer on a wafer. Semiconductor wafers are planarized or polished to achieve a smooth, flat finish before performing process steps that create integrated circuitry or interconnects on the wafer. A considerable amount of effort in the manufacturing of modern complex, high density multilevel interconnects is devoted to the planarization of the individual layers of the interconnect structure. Non-planar surfaces create poor optical resolution of subsequent photolithography processing steps. Poor optical resolution prohibits the printing of high-density lines. Another problem with non-planar surface topography is the step coverage of subsequent metalization layers. If a step height is too large there is a serious danger that open circuits will be created. Planar interconnect surface layers are required in the fabrication of modem high-density integrated circuits. To this end, CMP tools have been developed to provide controlled planarization of both structured and unstructured wafers.

Carriers may generally be grouped into back-reference and front-reference carriers. Back-reference carriers typically have a rigid pressure plate for supporting the back surface of the wafer while the wafer is pressed against the polishing pad. Imperfections on the back surface of the wafer are pressed on by the rigid pressure plate creating areas of non-uniform pressure on the front surface of the wafer. A compliant thin film may be used to cover the rigid pressure plate reducing, but not eliminating, the non-uniform pressure areas.

Front-reference carriers typically have a diaphragm for supporting the back surface of the wafer. Imperfections on the back surface of the wafer are better absorbed by the diaphragm than with the thin film allowing for a more uniform pressure to be placed on the front surface of the wafer. However, even with a uniform pressure on the front surface of the wafer, other problems, such as non-uniform slurry distribution or different motions for different points on the front surface of the wafer cause non-uniform planarization results. The non-uniform planarization results are typically manifested as concentric bands on the front surface of the wafer that need an increased or decreased material removal rate. It may therefore be desirable to have different pressures on different concentric bands while maintaining a uniform pressure over each band.

Carriers providing different uniform pressures on different concentric bands generally accomplish this by having two or more plenums that may be individually pressurized over a diaphragm separated by barriers. However, these carriers generally have a discontinuity of pressure at the interface between the bands near the barrier. This is generally caused by the barrier experiencing a shear force due to the different pressures within the plenums. The shear force causes the barrier to change position, for example by slightly lifting and puckering the diaphragm, creating a narrow band of discontinuity of pressure on the diaphragm along the barrier.

What is needed is a carrier having a plurality of concentric plenums that may be individually pressurized for planarizing the front surface of a wafer that reduces the discontinuities at the barrier between the plenums.

SUMMARY OF THE INVENTION

The invention is a method and apparatus that may be used in a CMP tool to press the front surface of a wafer against a polishing pad during a planarization process. A puck and a diaphragm may be used, possibly in combination with other features such as a cushion ring, to form a plenum within which concentric balloon may be positioned. Individually controllable fluid communication paths may be used to communicate a pressure to the plenum and/or concentric balloons. The plurality of concentric balloons may be used to apply different pressing forces through the diaphragm to the back surface of a wafer. Each pressing force is preferably uniform within a concentric band. Pressing force discontinuities between concentric bands are minimized by using thin balloons that are not connected to the thicker diaphragm.

As an improvement to the invention, the puck may have a plurality of concentric grooves. Double-sided tape may be placed inside each groove and the balloons may be sealed, for example by bonding, to metal rings. The metal rings may be inserted into the grooves and connected to the puck by the double-sided tape. The balloons may then be in position to expand within the plenum and support the diaphragm. The balloons are preferably very thin, highly elastic and sufficiently inflated during a planarization process to substantially fill the plenum to prevent pressure discontinuities at the interface between balloons. The diaphragm is preferably thicker and preferably less elastic than the balloons to average and further reduces any small discontinuities in pressure that may still exist on the diaphragm.

As another improvement, a cushion ring may be positioned between the periphery of the bottom surface of the puck and the periphery of the top surface of the diaphragm. In this embodiment, the cushion ring forms part of the plenum and provides space between the puck and diaphragm. The space is preferably substantially completely filled by the balloons when the balloons are expanded during a planarization process. A retaining ring may be connected to the periphery of the bottom surface of the diaphragm below the cushion ring. The cushion ring is preferably elastic, thereby allowing the retaining ring some freedom of movement in relation to the puck.

The above-described apparatus is preferably used for pressing against a back surface of a wafer during a planarization process. An exemplary method starts by pressurizing the plenum behind the diaphragm to provide a substantially uniform pressing force against a back surface of a test wafer. The test wafer is planarized and then its front surface uniformity is measured. The test wafer is used to assist in determining the optimum pressure to apply to each balloon. Multiple iterations of planarizing, measuring and adjusting the balloons may be done to optimize the planarization process until the planarization process reaches a level suitable for production wafers. Even after production wafers are used in the planarization process, further iterations of measuring the wafer's front surface and adjusting the pressure within the balloons, and therefore the pressure against the diaphragm, may be performed to further improve the planarization process.

BRIEF DESCRIPTION OF THE DRAWINGS

The present invention will hereinafter be described in conjunction with the appended drawing figures, wherein like numerals denote like elements, and:

FIG. 3 is an exploded bottom perspective view of the wafer carrier illustrated in FIG. 1*a.

DETAILED DESCRIPTION OF EXEMPLARY EMBODIMENTS

An improved polishing apparatus and method utilized in the polishing of semiconductor substrates and thin films formed thereon will now be described. The invention may also be used to planarize a wide range of workpieces, but is particularly well suited for planarizing raw and STI wafers and wafers covered by a thin metal or dielectric layer. In the following description, numerous specific details are set forth illustrating Applicant's best mode for practicing the present invention and enabling one of ordinary skill in the art to make and use the present invention. It will be obvious, however, to one skilled in the art that the present invention may be practiced without these specific details. In other instances, well-known machines and process steps have not been described in particular detail in order to avoid unnecessarily obscuring the present invention.

Figure 3:
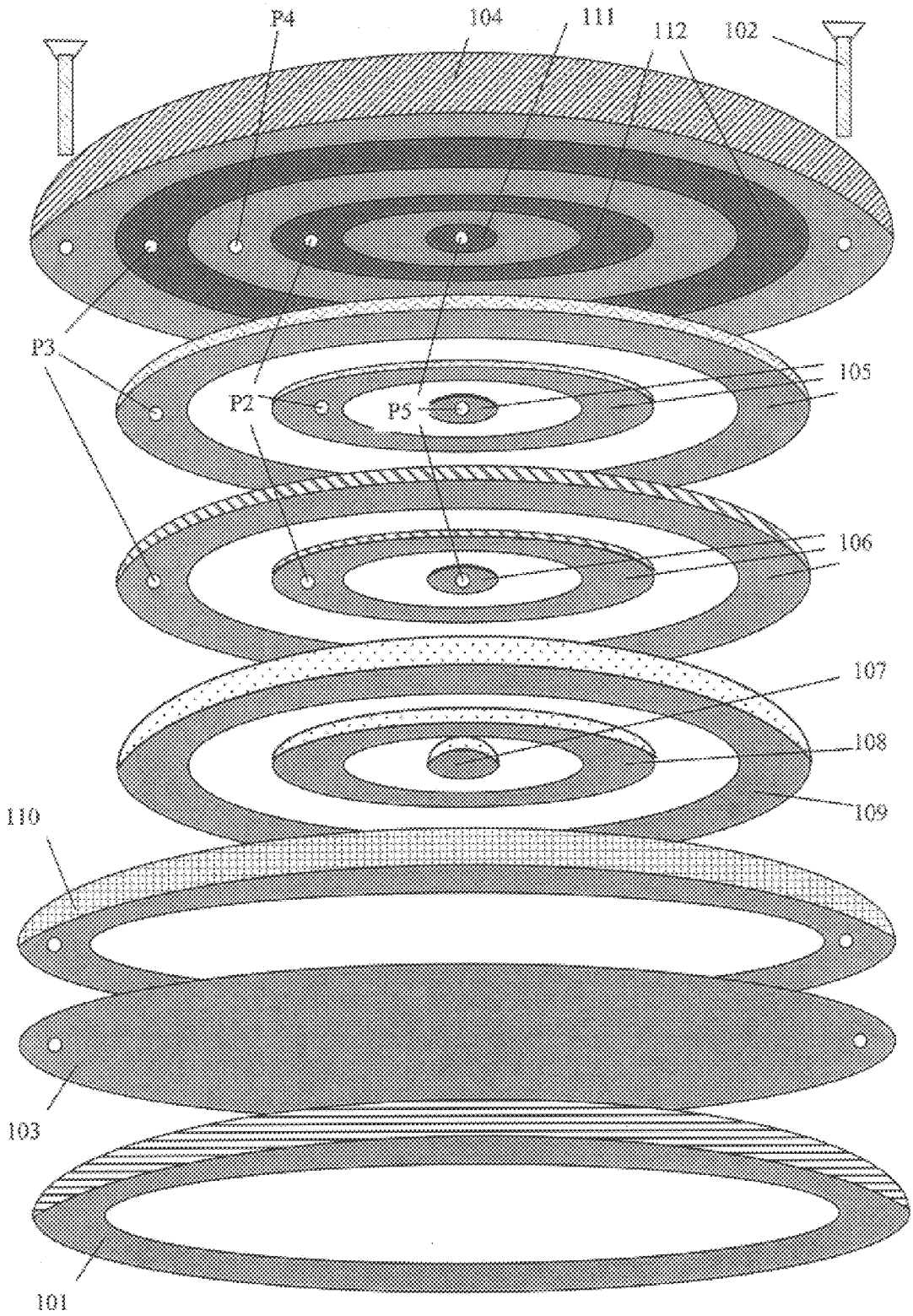

The invention is preferably attached to, or acts as, a wafer carrier within a CMP tool. An apparatus for practicing the present invention will now be disclosed with reference to FIGS. 1*a* and 3. A puck 104 acts as an upper housing support for the remaining components of the invention. The puck 104 may also have holes or other features, such as flanges, that allow the puck 104 to be easily connected to the rest of the CMP tool. The puck 104 may be connected to the rest of the CMP tool via a membrane, springs or other manner that allow the puck 104 to have some freedom in movement, but is preferably rigidly connected.

The puck 104 may be made from multiple pieces, but is preferably a single solid piece of material that does not adversely react, e.g. corrode, within its operating environment. The puck 104 will typically be exposed to corrosive chemicals contained in slurry as part of a CMP planarization process. Pucks 104 comprising stainless steal or aluminum have been found to perform well in a CMP environment.

The puck 104 preferably has a plurality of concentric grooves 112 surrounding a recessed central area 111. The greater the number of grooves 112 the better the process flexibility, but the greater the complexity and expense of the invention. A central area 111 and two concentric grooves 112 are preferred for planarizing a 200 mm wafer and a central area 111 and four concentric grooves 112 are preferred for planarizing a 300 mm wafer.

Double-sided tape 105 may be cut into the shape of the grooves 112 and central recessed area 107 and pressed into place. The double-sided tape 105 may be purchased from 3M as 9469 or 4920 double-sided tape. The tape 105 is preferably slightly compressible and elastic to allow metal rings 106 (described below) and balloons 107–109 (described below) to float in relation to the puck 104 during the planarization process.

A plurality of balloons 107–109 are sealed, preferably by bonding, to a corresponding plurality of metal rings 105. The balloons 107–109 and metal rings 105 should correspond in shape and size to fit into the grooves 112 and central recessed area 111. The metal rings 105 may then be pressed against the double-sided tape 105 with about 15 psi to connect the metal rings 105 and balloons 107–109 to the puck 104.

Figure 2:
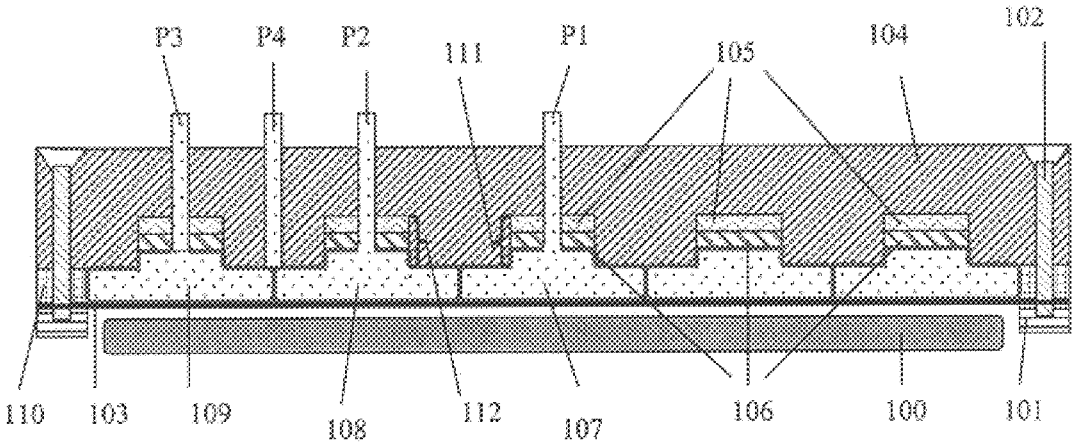
FIG. 2 is a cross section view of the wafer carrier illustrated in FIG. 1*a,* but with the supporting balloons in an expanded state.

The balloons 107–109 may advantageously be made very thin, about 0.3 mm or less, and preferably about 0.25 mm. The balloons 107–109 preferably comprise a super elastic material such as latex. The balloons 107–109 may be made very thin since they experience minimal shear force during the planarization process due to the protection of the diaphragm 103. The thinness and elasticity of the balloons 107–109 allows the balloons 107–109 to substantially fill the plenum 113 behind the diaphragm 103 when inflated as illustrated in FIG. 2. This minimizes discontinuities in pressure on the diaphragm 103 as substantially the entire top surface of the diaphragm 103 is supported by a balloon 107–109. The inflated balloons 107–109 contact each other and the diaphragm 103, but are not connected to the diaphragm 103. This also minimizes discontinuities in pressure on the diaphragm 103 as the pressure within each balloon 107–109 may be changed, and thus the contact position of the balloons 107–109 moved, without lifting or puckering the diaphragm 103.

The pressure for the balloons 107, 108 and 109 may be controlled through fluid communication paths P1, P2 and P3 respectively. The pressure for the plenum 113 may be controlled through fluid communication path P4. The fluid communication paths P14 preferably include a pressure regulator for each fluid communication path and a common pump. A control system (not shown) may be used to set the pressure regulators, before, during or after the planarization process, thereby automating the process of pressurizing the balloons 107–109 and plenum 113. The pressure within the plenum 113 and balloons 107–109 may be customized to optimize the planarization process. Typically, lower pressures are beneficial for planarizing softer materials while higher pressures are needed for harder materials. Current materials, such as copper and silicon dioxide are preferably planarized with the balloons 107–109 pressurized between about 2 to 6 psi and the plenum 113 pressurized between about 4–5 psi. The optimum pressure for the balloons 107–109 and plenum 113 may vary substantially from CMP tool to CMP tool and from type of workpiece to type of workpiece. Therefore, the optimum pressure settings for the balloons 107–109 and plenum 113 will generally need to be found empirically for every CMP tool and for every type of workpiece.

A cushion ring 110 may be used to create a space, i.e. plenum 113, between the puck 104 and the diaphragm 103. The cushion ring 1 10 preferably has an outer diameter equal to the outer diameter of the puck 104. The cushion ring 110 preferably has a height sufficient to give the balloons 107–109 adequate space to inflate within the plenum 113. The cushion ring 110 may be rigid, but is preferably slightly elastic to allow the retaining ring 101 (described below) some freedom of movement in relation to the puck 104.

The diaphragm 103 is preferably connected to the puck 104 via the cushion ring 110. The diaphragm 103 is preferably thicker than the balloons 107–109, e.g. about 0.5 to 3 mm, to average the pressures exerted on the back surface of the diaphragm 103 at the interface between balloons 107–109 having different pressures. The diaphragm should be elastic and may be made from EPDM or SBR. One or more holes (not shown) may be made in the diaphragm 103 above where the wafer 100 makes contact with the diaphragm 103. The wafer 100 seals the holes during a planarization process. The holes allow a vacuum to be applied in plenum 113 by fluid communication path P4 to pick-up wafers 100 or to evacuate the air from the plenum 113 to more fully allow the balloons 107–109 to inflate within the plenum 113.

A retaining ring 101, in combination with the bottom surface of the diaphragm 103, may be used to create a pocket for retaining the wafer 100 during a planarization process. A fastener 102 may be used to attach the retaining ring to the diaphragm 103, cushion ring 110 and puck 104. One specific fastener that may be used is a plurality of screws 102 positioned around the periphery of the puck 104. Of course, those skilled in the art will appreciate that other fastening methods may easily be used. The retaining ring 101 should be non-corrosive, and when worn, should not give off particles that will scratch the wafer 100. Examples of suitable materials for comprising the retaining ring 101 are PEEK, SiC, PET or Aluminum. The inside diameter of the retaining ring 101 is preferably rounded to avoid damaging the wafer 100.

Figure 1A:
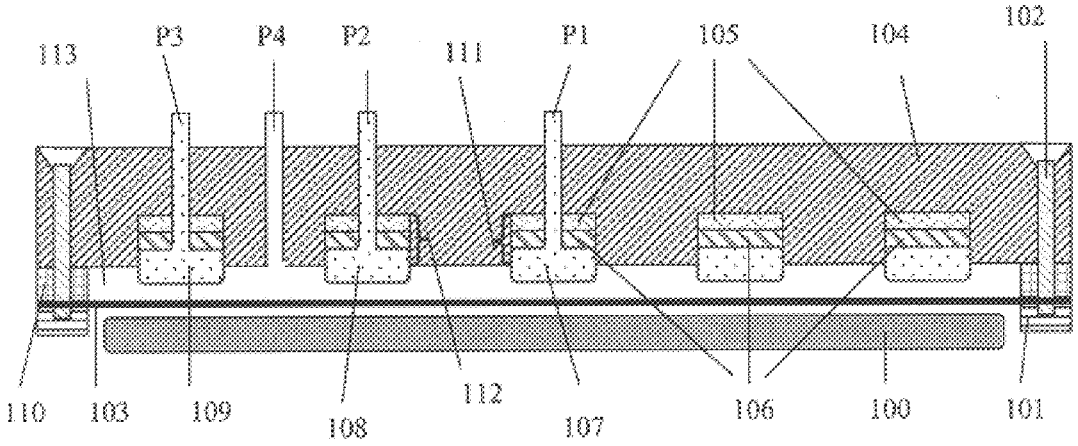
FIG. 1*a* is a cross section view of a wafer carrier according to an embodiment of the invention with the supporting balloons in a contracted state.
Figure 1B:
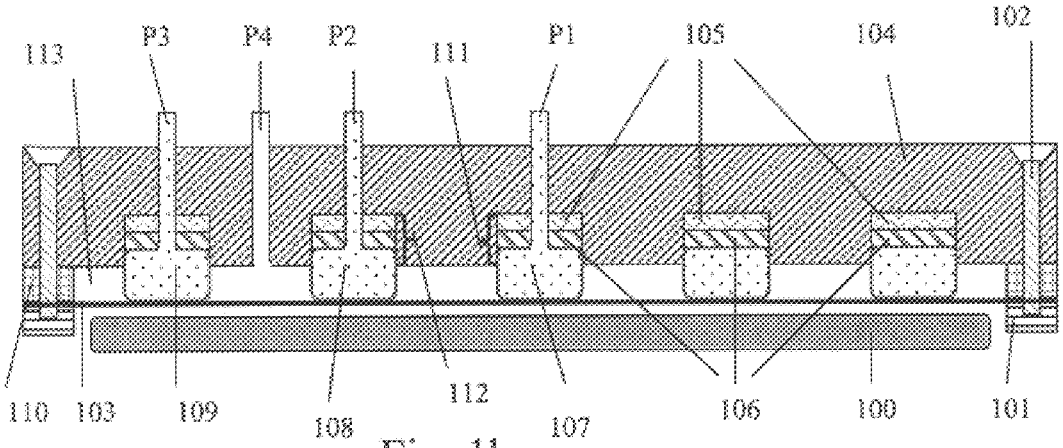
FIG. 1*b* is a cross section view of the wafer carrier illustrated in FIG. 1*a,* but with the supporting balloons in a partially expanded state.
Figure 4:
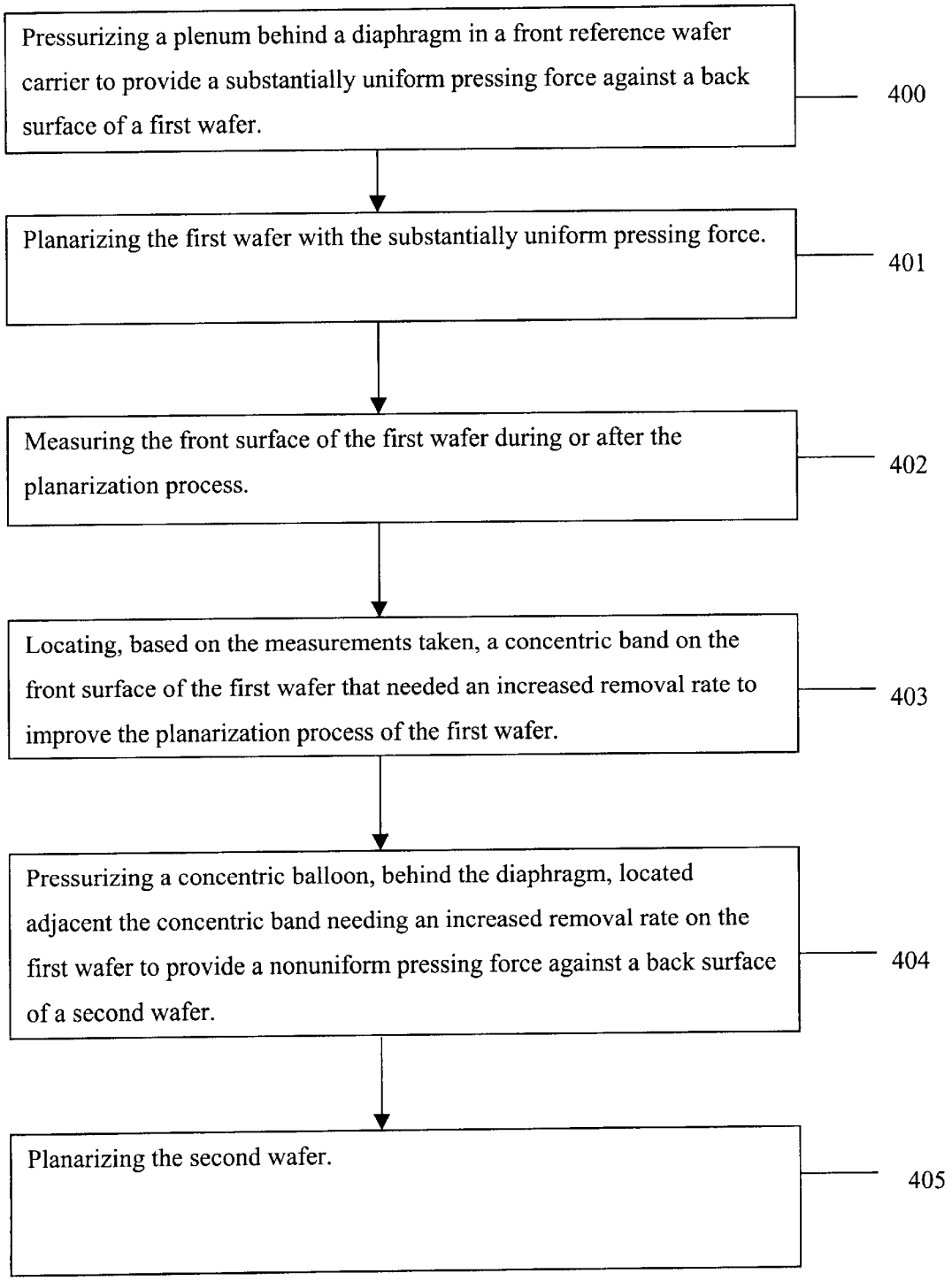
* and FIG. 4 is a flow chart illustrating an exemplary method of using the invention.

A method for planarizing a wafer 100 will now be disclosed with reference to FIG. 4. The balloons 107–109 are initially not inflated so that they do not press on the back surface of the diaphragm 103 (as shown in FIG. 1*a*). The plenum 113 may then be pressurized, for example to 5 psi, through fluid communication path P4 to provide a uniform pressing surface against the back surface of the wafer 100. (step 400) The wafer 100 may then be planarized (step 401) and the material removal rate profile determined. Measurements may be taken before, during and/or after the planarization process to determine where and how much material was removed across the front surface of the wafer 100 during the planarization process (step 402). The measurements may be analyzed to determine if concentric bands exist on the front surface of the wafer that needed an increased removal rate to improve the planarization process (step 403). Because CMP tools are generally able to repeat a process given the same type of wafer, this information may be used to predict how the next wafer is likely to be planarized. One or more of the balloons 107–109 may be pressurized behind the locations adjacent concentric bands that are predicted to need an increased removal rate. The number of balloons 107–109 inflated and the pressure within each balloon 107–109 may be customized depending on the desired adjustments that are needed for the planarization process (step 404). FIG. 1*b* illustrates the balloons 107–109 inflated to a point where the balloons 107–109 do not totally fill the plenum 113. While a wafer 100 may be planarized with the balloons only partially filling the plenum 113, wafers are preferably planarized with the balloons substantially filling the plenum 113. The next wafer may then be planarize using this customized combination of pressures (step 405). Of course, the planarization results of all or some of the future wafers may also be measured to assist in continually adjusting the number and pressure of the balloons 107–109 to continually improve the planarization process. If the CMP tool is capable of taking in-situ measurements of the wafer 100, the number and pressure of the balloons 107–109 may even be adjusted during a planarization process to further improve the planarization results for that particular wafer 100.

While the invention has been described with regard to specific embodiments, those skilled in the art will recognize that changes can be made in form and detail without departing from the spirit and scope of the invention.

We claim:

1. An apparatus used for pressing against the back surface of a wafer during a planarization process comprising:

a) a puck having a bottom major surface forming a top surface of a plenum;

b) a diaphragm having a top major surface forming a bottom surface of the plenum; and c) a plurality of concentric balloons within the plenum attached to the puck and adapted for supporting the diaphragm, wherein the balloons are not connected to the diaphragm.

2. The apparatus of claim 1, wherein the puck has a plurality of concentric grooves.

3. The apparatus of claim 2, further comprising:

d) a plurality of concentric pieces of double-sided tape, wherein at least one piece of double-sided tape is placed in each concentric groove; and e) a plurality of metal rings, wherein each ring is bonded to one of the balloons and each ring is placed against one of the pieces of double-sided tape in one of the concentric grooves.

4. The apparatus of claim 1, wherein the balloons are about, or less than, 0.25 mm thick.

5. The apparatus of claim 4, wherein the diaphragm is between about 0.5 and 3 mm thick.

6. The apparatus of claim 1, wherein the balloons comprise a super elastic material.

7. The apparatus of claim 1, wherein the balloons substantially fill the plenum when inflated.

8. The apparatus of claim 1, wherein the balloons comprise latex.

9. The apparatus of claim 1, further comprising a plurality of fluid communication paths adapted for individually pressurizing the plurality of balloons.

10. The apparatus of claim 9, further comprising a fluid communication path adapted to pressurize the plenum.

11. The apparatus of claim 1, further comprising:

d) a cushion ring positioned between the periphery of the bottom surface of the puck and the periphery of the top surface of the diaphragm; and e) a retaining ring connected to the periphery of the bottom surface of the diaphragm.

12. The apparatus of claim 11, wherein the inside diameter of the retaining ring has a rounded lower edge.

13. A method of using an apparatus for pressing against a back surface of a wafer comprising the steps of:

a) pressurizing a plenum behind a diaphragm in a front reference wafer carrier to provide a substantially uniform pressing force against a back surface of a first wafer;

b) planarizing the first wafer with the substantially uniform pressing force;

c) measuring the front surface of the first wafer during or after the planarization process;

d) locating, based on the measurements taken, a concentric band on the front surface of the first wafer that needed an increased removal rate to improve the planarization process of the first wafer;

e) pressurizing a concentric balloon, behind the diaphragm, located adjacent the concentric band needing an increased removal rate on the first wafer to provide a non-uniform pressing force against a back surface of a second wafer; and f) planarizing the second wafer.

* * * * *